US012631405B2

(12) United States Patent
Tanaka

(10) Patent No.: US 12,631,405 B2
(45) Date of Patent: May 19, 2026

(54) VAPOR CHAMBER AND METHOD FOR PRODUCING VAPOR CHAMBER

(71) Applicant: FURUKAWA ELECTRIC CO., LTD., Tokyo (JP)

(72) Inventor: Kengo Tanaka, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 266 days.

(21) Appl. No.: 18/002,908

(22) PCT Filed: Jun. 25, 2021

(86) PCT No.: PCT/JP2021/024251
§ 371 (c)(1),
(2) Date: Dec. 22, 2022

(87) PCT Pub. No.: WO2022/004618
PCT Pub. Date: Jan. 6, 2022

(65) Prior Publication Data
US 2023/0258416 A1 Aug. 17, 2023

(30) Foreign Application Priority Data
Jun. 30, 2020 (JP) ..... 2020-112762

(51) Int. Cl.
*F28F 3/12* (2006.01)
*F28D 15/02* (2006.01)
*F28D 15/04* (2006.01)

(52) U.S. Cl.
CPC ..... *F28F 3/12* (2013.01); *F28D 15/0233* (2013.01); *F28D 15/046* (2013.01); *F28F 2255/08* (2013.01); *F28F 2260/00* (2013.01)

(58) Field of Classification Search
CPC ..... F28F 3/12; F28F 2255/08; F28F 2260/00; F28D 15/0233; F28D 15/046
See application file for complete search history.

(56) References Cited

U.S. PATENT DOCUMENTS 5,465,782 A * 11/1995 Sun ..... F28D 15/046 165/104.33
6,148,906 A * 11/2000 Li ..... F28D 15/046 361/679.52

(Continued)

FOREIGN PATENT DOCUMENTS

JP 2019039662 A * 3/2019
JP 2019-158323 A 9/2019

(Continued)

OTHER PUBLICATIONS

International Search Report issued Aug. 3, 2021 in PCT/JP2021/024251, filed on Jun. 25, 2021, 2 pages.

*Primary Examiner* — Tho V Duong
(74) *Attorney, Agent, or Firm* — Oblon, McClelland, Maier & Neustadt, L.L.P.

(57) ABSTRACT

A vapor chamber has a working fluid in an internal space formed between a first metal sheet and a second metal sheet, in which the first metal sheet includes a recessed channel and at least one projecting part. The recessed channel is provided at an inner surface of the first metal sheet; the projecting part projects from the inner surface of the first metal sheet toward the second metal sheet, and a top face of the projecting part abuts the second metal sheet. The vapor chamber includes at least one top face joining part and gap flow channel part, the top face joining part joins part of the top face of the projecting part and the second metal sheet, and the top face and the second metal sheet are separated at the gap flow channel part.

18 Claims, 8 Drawing Sheets

(56) References Cited

U.S. PATENT DOCUMENTS

| | | | | |
|---|---|---|---|---|
| 6,293,332 | B2 * | 9/2001 | Li | F28D 15/046 165/104.33 |
| 2005/0022978 | A1 * | 2/2005 | Duval | H01L 23/427 257/E23.088 |
| 2015/0060022 | A1 * | 3/2015 | Sun | F28D 15/04 29/890.032 |
| 2017/0350657 | A1 * | 12/2017 | Yeh | F28D 15/046 |
| 2020/0025458 | A1 | 1/2020 | Takahashi et al. | |
| 2021/0095930 | A1 | 4/2021 | Inagaki et al. | |

FOREIGN PATENT DOCUMENTS

| | | | | | |
|---|---|---|---|---|---|
| JP | 2019-178860 | A | | 10/2019 | |
| JP | 2019173978 | A | * | 10/2019 | C23F 1/02 |
| JP | 2019-207076 | A | | 12/2019 | |

* cited by examiner

VAPOR CHAMBER AND METHOD FOR PRODUCING VAPOR CHAMBER

TECHNICAL FIELD

The present disclosure relates to a vapor chamber and a manufacturing method of a vapor chamber.

BACKGROUND ART

Electronic components such as semiconductor elements mounted in electrical/electronic devices such as notebook computers, digital cameras and mobile telephones are in a trend of increasing heat generation amount, due to the high-density mounting accompanying improved performance. In order to correctly drive an electrical/electronic device over a long period, it is necessary to efficiently cool the electronic components.

For example, Patent Document 1 discloses a vapor chamber having a first metal sheet and a second metal sheet, and including a liquid flow passage part in a sealed space provided between the first metal sheet and the second metal sheet. In the vapor chamber of Patent Document 1, for each groove constituting the liquid flow passage part, the width of a first communication groove is larger than the width of a first main flow groove and the width of a second main flow groove, the width of a second communication groove is larger than the width of the second main flow groove and the width of a third main flow groove, the depth of the first communication groove is deeper than the depth of the first main flow groove and the depth of the second main flow groove, and the depth of the second communication groove is deeper than the depth of the second main flow groove and the depth of the third main flow groove.

In the vapor chamber of Patent Document 1, the first metal sheet and the second metal sheet are joined by diffusion bonding, brazing or the like. When performing diffusion bonding or brazing, the first metal sheet and the second metal sheet are heat treated and annealed as a whole. Since the entirety of the vapor chamber is annealed in this way, the mechanical strength of the vapor chamber decline. In addition, in the vapor chamber of Patent Document 1, an improvement in heat transport efficiency is achieved by each groove constituting the liquid flow passage part satisfying a predetermined relationship. However, it is insufficient in addressing the demand of cooling performance of the electrical/electronic device which are increasing in recent years.

Patent Document 1: Japanese Unexamined Patent Application, Publication No. 2019-158323

DISCLOSURE OF THE INVENTION

Problems to be Solved by the Invention

An object of the present disclosure is to provide a vapor chamber superior in mechanical strength and heat transport characteristic and a manufacturing method of the vapor chamber.

Means for Solving the Problems

According to a first aspect of the present disclosure, a vapor chamber includes a working fluid in an internal space formed between a first metal sheet and a second metal sheet, in which the first metal sheet comprises a recessed channel and at least one projecting part; the recessed channel is provided at an inner surface of the first metal sheet; the projecting part projects from the inner surface of the first metal sheet toward the second metal sheet, and a top face of the projecting part abuts the second metal sheet; the vapor chamber includes at least one top face joining part and gap flow channel part; the top face joining part joins part of the top face of the projecting part and the second metal sheet; and the top face and the second metal sheet are separated at the gap flow channel part.

According to a second aspect of the present disclosure, in the vapor chamber as described in the first aspect, the gap flow channel part is provided between a top face abutting part not joined to the second metal sheet in the top face of the first metal sheet, and an inner surface abutting part of the second metal sheet abutting the top face abutting part; the gap flow channel part has a sealed part at a top face joining part side of the top face abutting part; and the gap flow channel part has an opening part at a projecting part lateral face side of the top face abutting part.

According to a third aspect of the present disclosure, in the vapor chamber as described in the second aspect, the gap flow channel part has a longer gap length from the sealed part to the opening part than a gap width between the top face abutting part and the inner surface abutting part.

According to a fourth aspect of the present disclosure, in the vapor chamber as described in the second or third aspect, the gap flow channel part has an average value of a gap width between the top face abutting part and the inner surface abutting part of 1.0 μm or more and 100.0 μm or less.

According to a fifth aspect of the present disclosure, in the vapor chamber as described in any one of the second to fourth aspects, the gap flow channel part has an average value of a gap length from the sealed part to the opening part of 40.0 μm or more.

According to a sixth aspect of the present disclosure, in the vapor chamber as described in any one of the second to fifth aspects, the gap flow channel part includes a gap enlarged part at a sealed part side; and an average value of a gap width between the top face abutting part and the inner surface abutting part at the gap enlarged part is larger than an average value of the gap width at the gap flow channel part other than the gap enlarged part.

According to a seventh aspect of the present disclosure, in the vapor chamber as described in any one of the first to sixth aspects, a ratio (t2/t1) of a sheet thickness t2 at the projecting part of the first metal sheet relative to a sheet thickness t1 at the recessed channel of the first metal sheet is 0.1 or more and 10.0 or less.

According to an eighth aspect of the present disclosure, in the vapor chamber as described in any one of the first to seventh aspects, the projecting part extends along a longitudinal direction of the vapor chamber.

According to a ninth aspect of the present disclosure, in the vapor chamber as described in any one of the first to eighth aspects, the vapor chamber includes a plurality of the top face joining parts at one of the projecting parts.

According to a tenth aspect of the present disclosure, in the vapor chamber as described in any one of the first to ninth aspects, the second metal sheet includes at least one projecting part at an inner surface; and the projecting part of the second metal sheet projects from the inner surface of the second metal sheet toward the first metal sheet, and a top face of the projecting part abuts the recessed channel of the first metal sheet.

According to an eleventh aspect of the present disclosure, a manufacturing method of the vapor chamber as described in any one of the first to tenth aspects includes: a laser bonding step of forming the top face joining part by laser.

According to a twelfth aspect of the present disclosure, the manufacturing method of the vapor chamber as described in the eleventh aspect further includes a laser welding step of welding an outer edge of the first metal sheet and an outer edge of the second metal sheet by laser, before or after the laser bonding step.

According to a thirteenth aspect of the present disclosure, the manufacturing method of the vapor chamber as described in the eleventh or twelfth aspect further includes a press processing step of forming the recessed channel and the projecting part of the first metal sheet by press molding, prior to the laser bonding step and the laser welding step.

Effects of the Invention

According to the present disclosure, it is possible to provide a vapor chamber superior in mechanical strength and heat transport characteristic and a manufacturing method of the vapor chamber.

PREFERRED MODE FOR CARRYING OUT THE INVENTION

Hereinafter, an embodiment will be explained in detail.

The present inventors, as a result of thorough examination, achieved an improvement in mechanical strength and heat transport characteristics, by focusing on the configuration of a joining part which joins the first metal sheet and the second metal sheet.

A vapor chamber of the embodiment includes a working fluid in an internal space formed between a first metal sheet and a second metal sheet, in which the first metal sheet comprises a recessed channel and at least one projecting part; the recessed channel is provided at an inner surface of the first metal sheet; the projecting part projects from the inner surface of the first metal sheet toward the second metal sheet, and a top face of the projecting part abuts the second metal sheet; the vapor chamber includes at least one top face joining part and gap flow channel part; the top face joining part joins part of the top face of the projecting part and the second metal sheet; and the top face and the second metal sheet are separated at the gap flow channel part.

First Embodiment

Figure 1:
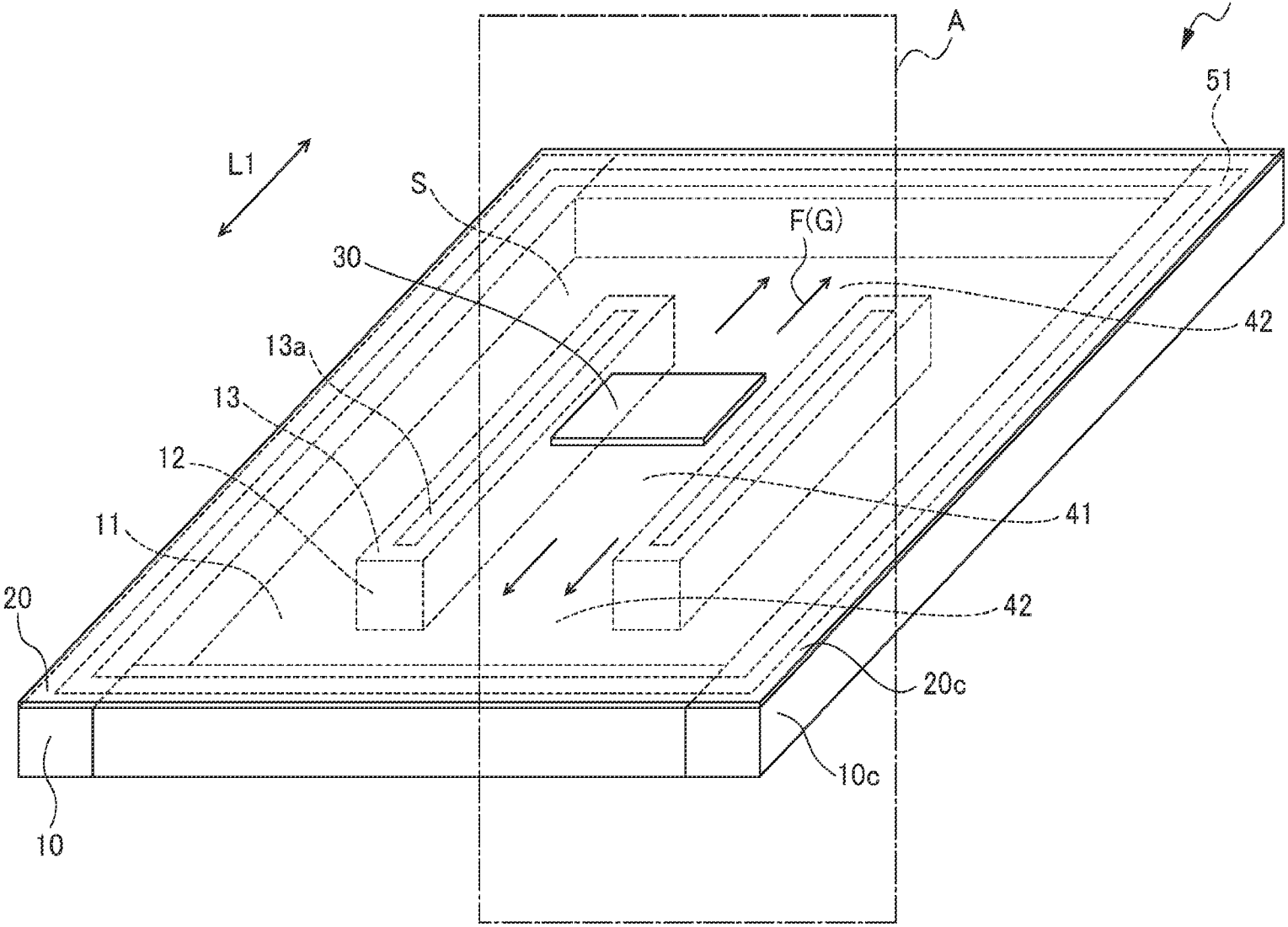
FIG. 1 is a perspective view showing an example of a vapor chamber according to a first embodiment.
Figure 2:
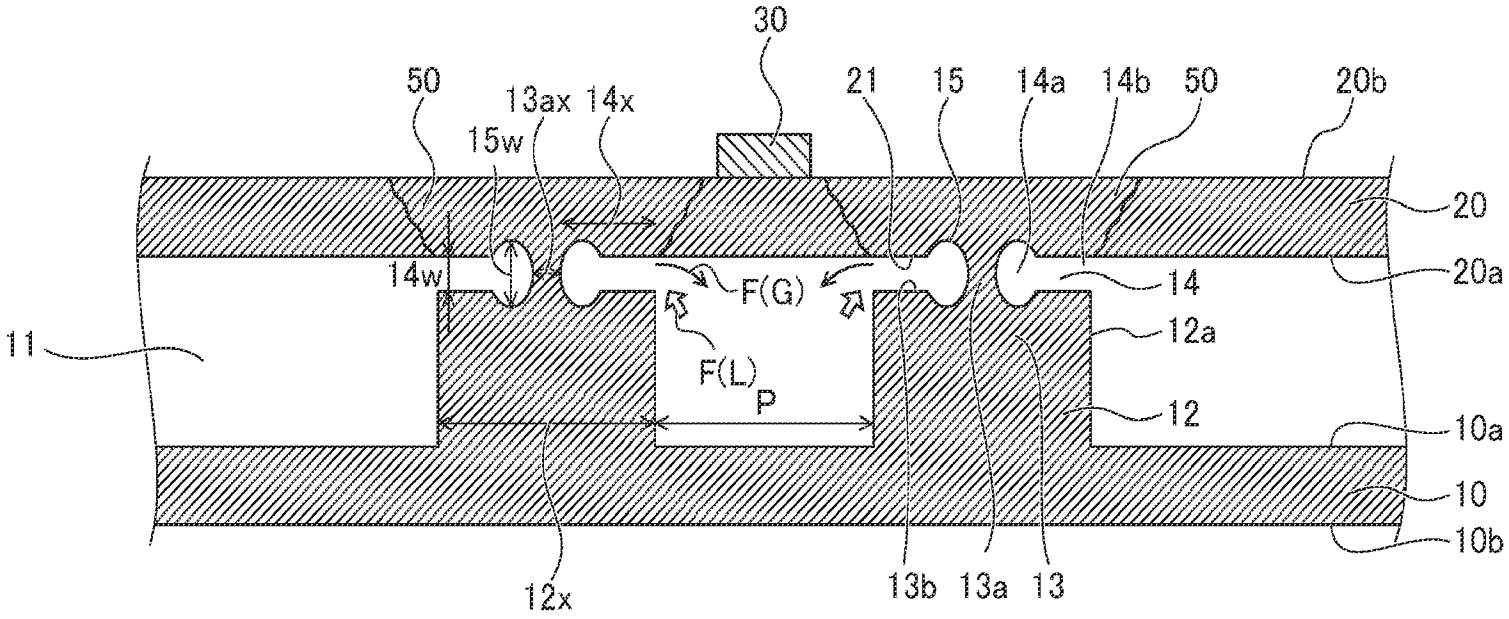
FIG. 2 is an enlarged cross-sectional view of a plane A in FIG. 1.

FIG. 1 is a perspective view showing an example of a vapor chamber according to a first embodiment. FIG. 2 is an enlarged cross-sectional view of a plane A in FIG. 1. For convenience, FIG. 1 shows an aspect partially penetrating so that the internal structure of the vapor chamber is understood. In addition, FIGS. 1 and 2 show the flow direction of the gas-phase working fluid F(G) by the black arrows, and show the flow direction of the liquid-phase working fluid F(L) by the white arrows.

As shown in FIGS. 1 and 2, the vapor chamber 1 of the first embodiment has a first metal sheet 10 and a second metal sheet 20. The first metal sheet 10 and the second metal sheet 20 are joined so that an inner surface 10*a* of the first metal sheet 10 and an inner surface 20*a* of the second metal sheet 20 are opposing. In other words, the first metal sheet 10 and the second metal sheet 20 have the insides closed. In addition, the vapor chamber 1 has a working fluid in an internal space S formed between the first metal sheet 10 and the second metal sheet 20. The internal space S is sealed by the first metal sheet 10 and the second metal sheet 20. The working fluid is enclosed in the internal space S provided inside of the vapor chamber 1.

As the working fluid enclosed in the internal space S, pure water, ethanol, methanol, acetone, etc. can be exemplified from the viewpoint of cooling performance of the vapor chamber 1.

The first metal sheet 10 constituting the vapor chamber 1 includes a recessed channel 11 and at least one projecting part 12.

As shown in FIG. 1, the recessed channel 11 is provided at the inner surface 10*a* of the first metal sheet 10. The recessed channel 11 provided on the side of the inner surface 10*a* indents from an outer edge 10*c* of the first metal sheet 10 along the center of the inner surface 10*a*. For example, the recessed channel is a space from the internal space S excluding the projecting part 12 and gap flow channel part 14. The gas-phase working fluid mainly flows in the recessed channel 11.

The projecting part 12 projects from the inner surface 10*a* of the first metal sheet 10 toward the inner surface 20*a* of the second metal sheet 20. A top face 13 of the projecting part 12 abuts the inner surface 20*a* of the second metal sheet 20. For example, the projecting part 12 is a square columnar shape.

As shown in FIG. 2, the vapor chamber 1 includes at least one top face joining part 13*a* and a gap flow channel part 14.

The top face joining part 13*a* joins part of the top face 13 of the projecting part 12 and the second metal sheet 20. In this way, at the abutting surface between the top face 13 of the projecting part 12 and the inner surface 20*a* of the second metal sheet 20, the top face joining part 13*a* joins part of the top face 13 of the projecting part 12 and part of the inner surface 20*a* of the second metal sheet 20.

The vapor chamber 1 locally possesses an annealed part 50 at a portion adjacent to the top face joining part 13*a*, rather than over the entirety of the vapor chamber 1. The annealed part 50 is produced by heating when forming the top face joining part 13*a* which joins the first metal sheet 10 and the second metal sheet 20. For example, as shown in FIG. 2, the vapor chamber 1 possesses the annealed part 50 formed at the second metal sheet 20 adjacent to the top face joining part 13*a*. The metallographic structure of the annealed part 50 and the metallographic structure of the portion other than the annealed part 50 clearly differ when observed by SEM.

The first metal sheet 10 and the second metal sheet 20 are joined via the top face joining part 13*a*. The length 13*ax* of the top face joining part 13*a* which joins part of the top face 13 and part of the inner surface 20*a* is smaller than the length

12*x* of the projecting part 12. From the viewpoint of suppressing a decline in mechanical strength of the vapor chamber 1, the ratio (13*ax*/12*x*) of the length 13*ax* of the top face joining part 13*a* relative to the length 12*x* of the projecting part 12 is preferably smaller than 0.5. The length 13*ax* of the top face joining part 13*a* and the length 12*x* of the projecting part 12 are distances in a direction perpendicular to the thickness direction of the vapor chamber 1, in a cross section of the vapor chamber 1 including the top face joining part 13*a* such as that shown in FIG. 2.

At the gap flow channel part 14, the top face 13 of the first metal sheet 10 and the second metal sheet 20 are separated. The liquid-phase working fluid flows in the gap flow channel part 14.

Such a gap flow channel part 14 is provided between the top face abutting part 13*b* of the top face 13 of the projecting part 12 and an inner surface abutting part 21 of the second metal sheet 20. The top face abutting part 13*b* of the first metal sheet 10 is a portion of the top face 13 of the first metal sheet 10 which is not joined to the inner surface 20*a* of the second metal sheet 20. The inner surface abutting part 21 of the second metal sheet 20 is a portion of the inner surface 20*a* of the second metal sheet 20 which abuts the top face abutting part 13*b*.

The top face abutting part 13*b* and the inner surface abutting part 21 are separably abutting each other without being joined. The gap flow channel part 14 is a gap occurring at the abutting of the top face abutting part 13*b* and the inner surface abutting part 21. It should be noted that, herein for convenience, a state in which the top face abutting part 13*b* and the inner surface abutting part 21 are clearly distanced is shown so as to facilitate understanding the gap flow channel part 14.

In addition, the gap flow channel part 14 has a sealed part 14*a* at a top face joining part 13*a* side of the top face abutting part 13*b*. The sealed part 14*a* is a portion at which the top face abutting part 13*b* and the top face joining part 13*a* connect, and is sealed by the top face joining part 13*a*. In addition, the gap flow channel part 14 has an opening part 14*b* at a projecting part lateral face side of the top face abutting part 13*b*. The projecting part lateral face side is a lateral face 12*a* side of the projecting part 12, which is a recessed channel 11 side. In this way, in the gap flow channel part 14, the top face joining part 13*a* side of the top face abutting part 13*b* is sealed, and the projecting part lateral face side of the top face abutting part 13*b* is open.

The gap flow channel part 14 is provided at a top face 13 side of the projecting part 12, between the recessed channel 11 and the top face joining part 13*a*. At the top face 13 side of the projecting part 12, the gap flow channel part 14 provided at the circumference of the top face joining part 13*a* extends in a direction perpendicular to the thickness direction of the vapor chamber 1. The gap flow channel part 14 communicates with the recessed channel 11 via the opening part 14*b*. More specifically, the gap flow channel part 14 communicates with the recessed channel 11 at a side of the second metal sheet 20.

The gap width 14*w* of the gap flow channel part 14 is very small compared to the groove interval p of the recessed channel 11. The gap width 14*w* of the gap flow channel part 14 is the distance between the top face abutting part 13*b* and the inner surface abutting part 21. The groove interval p of the recessed channel 11 is the distance between adjoining projecting parts 12 or the distance between a projecting part 12 and an outer edge 10*c*. As described above, the gap flow channel part 14 is a gap occurring at the abutting of the top face abutting part 13*b* and the inner surface abutting part 21, and the gap width 14*w* of the gap flow channel part 14 is very small. For this reason, the gap flow channel part 14 exhibits a capillary phenomenon relative to the liquid-phase working fluid.

The vapor chamber 1 cools the heat generating body 30 mainly by the following cooling path.

The heat generated by the heat generating body 30 thermally connected with the outer surface 20*b* of the second metal sheet 20 is transferred to the evaporation part 41 positioned at the inner surface 20*a* of the second metal sheet 20. The evaporation part 41 causes the liquid-phase working fluid flowing in the gap flow channel part 14 to evaporate and phase change to gas-phase working fluid as shown by the arrow F(G) as shown in FIG. 2, by the heat transferred from the heat generating body 30. The gas-phase working fluid heated by evaporation flows to the condensation part 42 at a position distanced from the evaporation part 41, as shown by the arrow F(G) in FIG. 1. In the course of the gas-phase working fluid flowing toward the condensation part 42, the temperature of the working fluid drops. In the condensation part 42, the gas-phase working fluid which has dropped in temperature is condensed and phase changes to the liquid-phase working fluid. The latent heat generated by phase change is transferred to the first metal sheet 10 or the second metal sheet 20, and is radiated to outside of the vapor chamber 1. The condensed liquid-phase working fluid easily infiltrates into the gap flow channel part 14 by the capillary phenomenon as shown by the arrow F(L) in FIG. 2. The liquid-phase working fluid migrates in the gap flow channel part 14 and returns to the evaporation part 41 again. By such favorable circulation of the liquid-phase working fluid and the gas-phase working fluid, the vapor chamber 1 can efficiently cool the heat generating body 30.

When the vapor chamber 1 includes the gap flow channel part 14 at the top face 13 side of the projecting part 12, the liquid-phase working fluid easily infiltrates the gap flow channel part 14 from the recessed channel 11 and the liquid-phase working fluid in the gap flow channel part 14 hardly leaks to outside of the gap flow channel part 14, by the capillary phenomenon of the gap flow channel part 14 relative to the liquid-phase working fluid. On the other hand, in a conventional vapor chamber not including such a gap flow channel part 14, since a configuration corresponding to the gap flow channel part 14 of the vapor chamber 1 is not provided, the liquid-phase working fluid flows in the recessed channel. In this way, compared to conventional, in the vapor chamber 1 including the gap flow channel part 14, the retention amount of the liquid-phase working fluid increases, and the recirculation amount of the working fluid increases. For this reason, the heat transport amount in the internal space S improves. Furthermore, in the internal space S of the vapor chamber 1, it is possible to suppress a state in which the liquid-phase working fluid is not present in the evaporation part, i.e. dry-out, the flow of circulation of the liquid-phase working fluid and the gas-phase working fluid become favorable, and the heat transport improves. Based on such a fact, the vapor chamber 1 can have superior heat transport characteristic.

Furthermore, the gap flow channel part 14 easily takes in the liquid-phase working fluid inside and hardly leaks the liquid-phase working fluid taken inside to outside of the gap flow channel part 14 by the capillary phenomenon. For example, even if the vapor chamber 1 is in any posture, such as a state in which the vapor chamber 1 shown in FIG. 1 inclines 90 degrees within the paper plane, or a state up-side down, the liquid-phase working fluid easily enters the gap flow channel part 14, and the liquid-phase working fluid hardly leaks to outside from the gap flow channel part 14. In this way, the heat transport characteristic of the vapor chamber 1 is superior, due to the flow of circulation of the liquid-phase working fluid and the gas-phase working fluid being favorable, independently of the arrangement state of the vapor chamber 1.

Furthermore, the vapor chamber 1 locally includes the annealed part 50 produced by heating when forming the top face joining part 13*a*, at a portion adjacent to the top face joining part 13*a*, rather than the entirety of the vapor chamber 1. The annealed part 50 made by heat treatment causes the mechanical strength of the material to decline. The conventional vapor chamber does not locally provide an annealed part to a portion adjacent to the top face joining part 13*a* of the vapor chamber 1, but rather provides an annealed part over a wide area of the first metal sheet or the second metal sheet. In this way, compared to conventionally, in the vapor chamber 1, the region of the annealed part 50 is small, and it is possible to suppress a decline in mechanical strength by annealing. For this reason, the vapor chamber 1 can have superior mechanical strength.

In addition, the gap flow channel part 14 preferably has a gap length 14*x* from the sealed part 14*a* to the opening part 14*b* longer than the gap width 14*w* between the top face abutting part 13*b* and the inner surface abutting part 21. For the gap flow channel part 14, if the gap length 14*x* is longer than the gap width 14*w*, the retention amount of the liquid-phase working fluid in the gap flow channel part 14 increases, and the capillary phenomenon of the gap flow channel part 14 improves. For this reason, the heat transport characteristic of the vapor chamber 1 further improves.

From the viewpoint of improving the heat transport characteristic of the vapor chamber 1, the ratio (14*x*/14*w*) of the gap length 14*x* relative to the gap width 14*w* is preferably 1.0 or more and 30.0 or less, and more preferably 2.0 or more and 10.0 or less.

In addition, the average value for the gap width 14*w* of the gap flow channel part 14 is preferably 1.0 μm or more and 100.0 μm or less, more preferably 3.0 μm or more and 50.0 μm or less, and even more preferably 5.0 μm or more and 20.0 μm or less. When the average value of the gap width 14*w* is 1.0 μm or more, it is possible to easily form the gap flow channel part 14. When the average value of the gap width 14*w* is 100.0 μm or less, since the capillary phenomenon of the gap flow channel part 14 improves, the heat transport characteristic of the vapor chamber 1 further improves.

In addition, the average value for the gap length 14*x* of the gap flow channel part 14 is preferably 40.0 μm or more, more preferably 80.0 μm or more, and even more preferably 150.0 μm or more. In addition, the average value of the gap length 14*x* is preferably 1.0 mm or less, more preferably 500.0 μm or less, and even more preferably 200.0 μm or less. When the average value of the gap length 14*x* is 40.0 μm or more, since the retention amount of the liquid-phase working fluid in the gap flow channel part 14 increases, and the capillary phenomenon of the gap flow channel part 14 improves, the heat transport characteristic of the vapor chamber 1 further improves. When the average value of the gap length 14*x* is 1.0 mm or less, it is possible to easily form the gap flow channel part 14.

In addition, it is preferable that, as shown in FIG. 2, the gap flow channel part 14 includes a gap enlarged part 15 at a sealed part 14*a* side, and the average value of the gap width 15*w* between the top face abutting part 13*b* and the inner surface abutting part 21 at the gap enlarged part 15 is larger than the average value of the gap width 14*w* between the top face abutting part 13*b* and the inner surface abutting part 21 at the gap flow channel part 14 other than the gap enlarged part 15. When the average value for the gap width 15*w* of the gap enlarged part 15 is longer than the average value of the gap width 14*w* between the top face abutting part 13*b* and the inner surface abutting part 21 at the gap flow channel part 14 other than the gap enlarged part 15, the retention amount of the liquid-phase working fluid in the gap flow channel part 14 and the gap enlarged part 15 increases, and the capillary phenomenon of the gap flow channel part 14 improves. For this reason, the heat transport characteristic of the vapor chamber 1 further improves.

From the viewpoint of improving the heat transport characteristic of the vapor chamber 1, the ratio (15*w*/14*w*) of the gap width 15*w* relative to the gap width 14*w* is preferably 1.1 or more and 2.0 or less. When the ratio (15*w*/14*w*) is 1.1 or more, the heat transport characteristic of the vapor chamber 1 improves. When the ratio (15*w*/14*w*) is 2.0 or less, it is possible to easily form the gap enlarged part 15.

In addition, from the viewpoint of improving the heat transport characteristic of the vapor chamber 1, the gap enlarged part 15 is preferably provided at the closest portion of the top face abutting part 13*b* to the top face joining part 13*a* as shown in FIG. 2, i.e. at the sealed part 14*a*. Similarly, from the viewpoint of improving the heat transport characteristic of the vapor chamber 1, the shape of the gap enlarged part 15 is preferably spheroidal, as shown in FIG. 2.

In addition, as shown in FIG. 1, the projecting part 12 preferably extends along the longitudinal direction L1 of the vapor chamber 1. When the projecting part 12 extends along the longitudinal direction L1 of the vapor chamber 1, the distance from the evaporation part 41 toward the condensation part 42 becomes longer, and the recirculation amount of the working fluid increases. For this reason, the heat transport characteristic of the vapor chamber 1 further improves.

Figure 8:
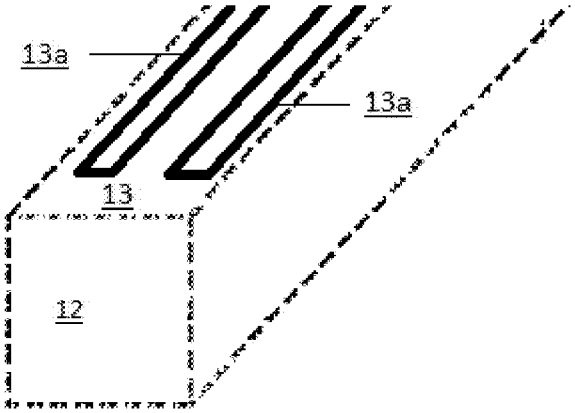
FIG. 8 is an enlarged partial view of a projecting part according to another example embodiment.

In addition, the vapor chamber 1 preferably includes a plurality of top face joining parts 13*a* at one of the projecting parts 12 as shown in the example of FIG. 8. When a plurality of the top face joining parts 13*a* is provided to one projecting part 12, the bonding strength of the first metal sheet 10 and the second metal sheet 20 improves. When a plurality of the top face joining parts 13*a* is provided to each projecting part 12, the bonding strength of the first metal sheet 10 and the second metal sheet 20 further improves.

Figure 3:
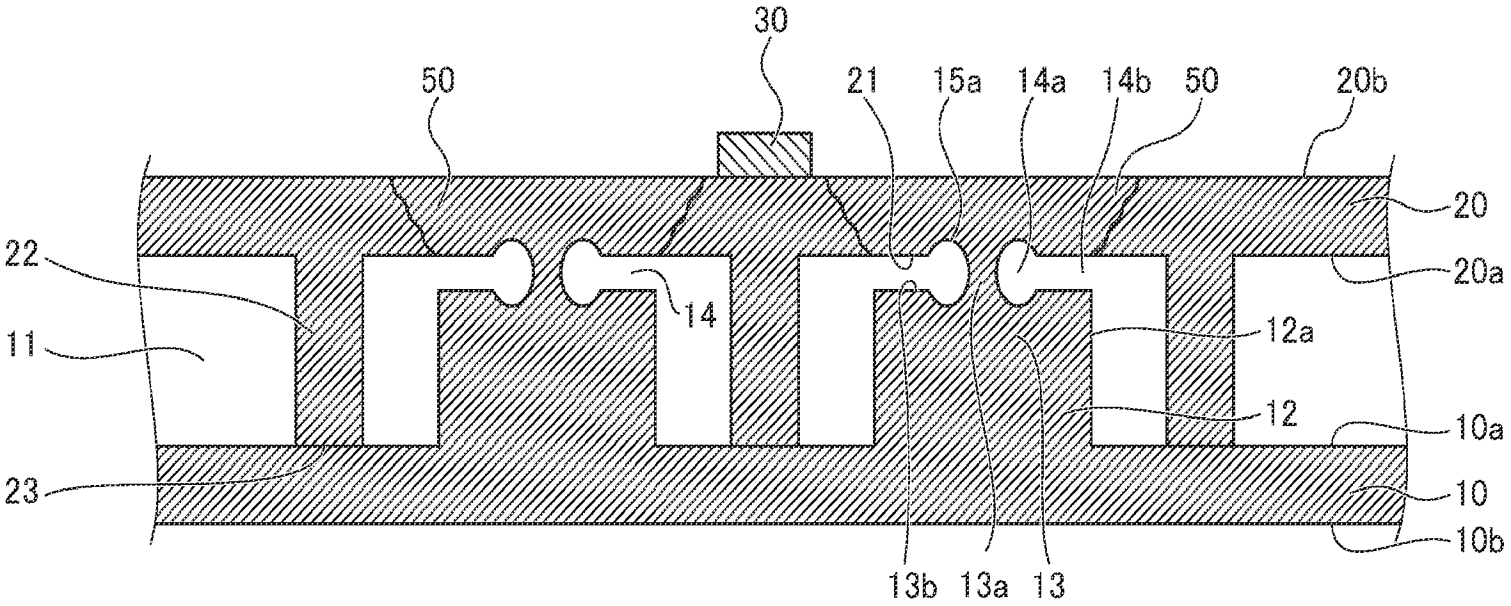
FIG. 3 is an enlarged cross-sectional view showing another example of a second metal sheet constituting the vapor chamber according to the first embodiment.

FIG. 3 is an enlarged cross-sectional view showing another example of the second metal sheet 20 constituting the vapor chamber 1. It is preferable that, as shown in FIG. 3, the second metal sheet 20 includes at least one projecting part 22 at the inner surface 20*a*, and the projecting part 22 of the second metal sheet 20 projects from the inner surface 20*a* of the second metal sheet 20 toward the first metal sheet 10, and the top face 23 of the projecting part 22 abuts the recessed channel 11 of the first metal sheet 10.

The top face 23 of the projecting part 22 of the second metal sheet 20 abuts the recessed channel 11, i.e. the inner surface 10*a* of the first metal sheet 10. For this reason, the mechanical strength relative to the thickness direction of the vapor chamber 1 further improves. In addition, the gap due to abutting is provided between the top face 23 of the projecting part 22 and the inner surface 10*a* of the first metal sheet 10. Since this gap also exhibits the capillary phenomenon relative to the liquid-phase working fluid similarly to the gap flow channel part 14, the liquid-phase working fluid is easily taken in this gap. For this reason, the heat transport characteristic of the vapor chamber 1 further improves.

In addition, the inner surface 10*a* of the first metal sheet 10 and the inner surface 20*a* of the second metal sheet 20 preferably have a roughened structure or a groove structure. The roughened structure is formed by roughening treatment on the inner surface 10*a* or the inner surface 20*a*. When the inner surface 10*a* or the inner surface 20*a* has a roughened structure or a groove structure, the liquid-phase working fluid tends to flow along these structures, and the circulation of the liquid-phase working fluid and the gas-phase working fluid become favorable. For this reason, the heat transport characteristic of the vapor chamber 1 further improves.

In the formation of the top face joining part 13*a* and the gap flow channel part 14 improving the heat transport characteristic of such a vapor chamber 1, as well as local formation of the annealed part 50, a process using a laser is preferable, and thereamong, a process using a fiber laser is more preferable. In a process by laser, it is possible to suppress formation enlargement of the annealed part 50, and to form the top face joining part 13*a* and the gap flow channel part 14 into a desired shape in a short time. As a result thereof, the annealed part 50 is not formed over a wide area of the vapor chamber 1, but is rather formed locally. On the other hand, in the joining of the first metal sheet and the second metal sheet by using of diffusion bonding adopted in a conventional vapor chamber, the processability is very low compared to laser processing, such as the formation of the top face joining part 13*a* and the gap flow channel part 14, particularly the formation of the gap flow channel part 14, being difficult, and the annealed part being formed over the entirety of the vapor chamber.

In addition, the material constituting the first metal sheet 10 and the second metal sheet 20 is preferably copper, copper alloy, aluminum, aluminum alloy or stainless steel, from the viewpoint of high thermal conductivity, processing ease by laser, etc. Thereamong, for the purpose of achieving weight reduction, aluminum or aluminum alloy is more preferable, and for the purpose of raising the mechanical strength, stainless steel is more preferable. In addition, depending on the use environment, tin, tin alloy, titanium, titanium alloy, nickel, nickel alloy, etc. may be used in the first metal sheet 10 and the second metal sheet 20.

The heat generating body 30 mounted to the vapor chamber 1 is a member such as an electronic component which generates heat during operation, such as a semiconductor element, for example.

Next, a manufacturing method of the above-mentioned vapor chamber 1 will be explained.

The manufacturing method of the vapor chamber 1 has a laser bonding step of forming the top face joining part 13*a* by laser. The laser bonding step preferably forms the top face joining part 13*a* which joins the first metal sheet 10 and the second metal sheet 20 by a fiber laser. In the laser processing, the top face joining part 13*a* tends to be process controlled to the desired shape, and the top face joining part 13*a* can be formed in a short time. Furthermore, in the laser processing, since the portion desired to be joined can be heated locally, the annealed part 50 produced by heating is not formed over a wide area of the vapor chamber 1, but rather is locally formed at a portion adjacent to the top face joining part 13*a*. Among lasers, the fiber laser is more superior in processing control and short-time processing. When the top face joining part 13*a* is formed, the gap flow channel part 14 is also formed as a result. Since the step of independently mounting a capillary structure (wick structure) such as conventionally is unnecessary, it is possible to achieve a reduction in production cost and production time, and simplification in production.

More specifically, in a state in which the inner surface 10*a* of the first metal sheet 10 including the recessed channel 11 and the projecting part 12, and the inner surface 20*a* of the second metal sheet 20 are opposing each other, and the top face 13 of the projecting part 12 of the first metal sheet 10 is abutting the inner surface 20*a* of the metal sheet 20, the laser is irradiated to part of the top face 13. For example, the laser may be irradiated from the first metal sheet 10 side to the part of the top face 13, the laser may be irradiated from the second metal sheet 20 side to the part of the top face 13, or the irradiation of these lasers may be combined.

On the other hand, in the joining by diffusion bonding which is adopted in a conventional vapor chamber or the like, the first metal sheet and the second metal sheet are entirely heat treated. In such heat treatment, since the entire surface of the top face 13 of the projecting part 12 is joined to the inner surface of the second metal sheet 20, formation itself of the top face joining part 13*a* and the gap flow channel part 14 is difficult. For this reason, in addition to the step of joining the first metal sheet and the second metal sheet, it is necessary to separately perform a step of installing a capillary structure. Furthermore, since the first metal sheet and the second metal sheet are entirely annealed by being heat treated, the mechanical strength of the vapor chamber declines.

In addition, the manufacturing method of the vapor chamber 1 preferably further has a laser welding step of welding the outer edge 10*c* of the first metal sheet 10 and the outer edge 20*c* of the second metal sheet 20 by laser, before or after the laser processing step. By welding the outer edge 10*c* of the first metal sheet 10 and the outer edge 20*c* of the second metal sheet 20 by laser, a welded part 51 is formed, and it is possible to easily manufacture the vapor chamber 1 including the internal space S inside. If the laser used in the laser bonding step and the laser used in the laser welding step are the same, it is possible to easily manufacture the vapor chamber in even shorter time.

More specifically, the laser is irradiated to the first metal sheet 10 and the second metal sheet 20 in a state in which the inner surface 10*a* of the first metal sheet 10 and the inner surface 20*a* of the second metal sheet 20 are opposing each other and the outer edge 10*c* of the first metal sheet 10 and the outer edge 20*c* of the metal sheet 20 are contacting. For example, the laser may be irradiated to a contacting portion of the outer edge 10*c* and the outer edge 20*c* from the first metal sheet 10 side, the laser may be irradiated to a contacting portion of the outer edge 10*c* and the outer edge 20*c* from the second metal sheet 20 side, the laser may be irradiated to a contacting portion of the outer edge 10*c* and the outer edge 20*c* from an in-plane direction of the vapor chamber 1, or the irradiation of these lasers may be combined.

The vapor chamber 1 manufactured in this way is suitably used in electronic devices such as portable telephones, for which good heat transport characteristics are required even in various postures. The electronic device equipped with the vapor chamber 1 has high heat transport characteristics of the vapor chamber 1, even in various usage states.

According to the above explained embodiment, since the liquid-phase working fluid easily infiltrates and flows in the gap flow channel part, the flow of circulation of the liquid-phase working fluid and the gas-phase working fluid improves, and the heat transfer within the internal space of the vapor chamber increases. For this reason, the vapor chamber can have superior heat transfer characteristics. In addition, in the vapor chamber, the annealed part is not provided over a wide area of the entire body, but rather is locally provided. For this reason, it is possible to suppress a decline in mechanical strength of the vapor chamber due to the annealed part.

It should be noted that, although the above description illustrates an example mounting the heat generating body 30 to the outer surface 20*b* of the second metal sheet 20 as shown in FIG. 1, the heat generating body 30 may be mounted to the outer surface 10*b* of the first metal sheet 10.

In addition, it is preferable to install the vapor chamber 1 so that the second metal sheet 20 is arranged on the side of the gravity direction, i.e. so that the second metal sheet 20 is arranged downward and the first metal sheet 10 is arranged upward along the gravity direction. When the vapor chamber 1 is installed so as to arrange the second metal sheet 20 on the gravity direction side, within the internal space S, the gap flow channel part 14 is arranged on the side of the gravity direction. The liquid-phase working fluid tends to enter the gap flow channel part 14 by gravity, in addition to the capillary phenomenon of the gap flow channel part 14. As a result thereof, the heat transport characteristic of the vapor chamber further improves. In such an installation state of the vapor chamber, when mounting the heat generating body 30 on the outer surface 20*b* of the second metal sheet 20, i.e. lower part of the vapor chamber 1, it is possible to efficiently cool the heat generating body 30.

Figure 4:
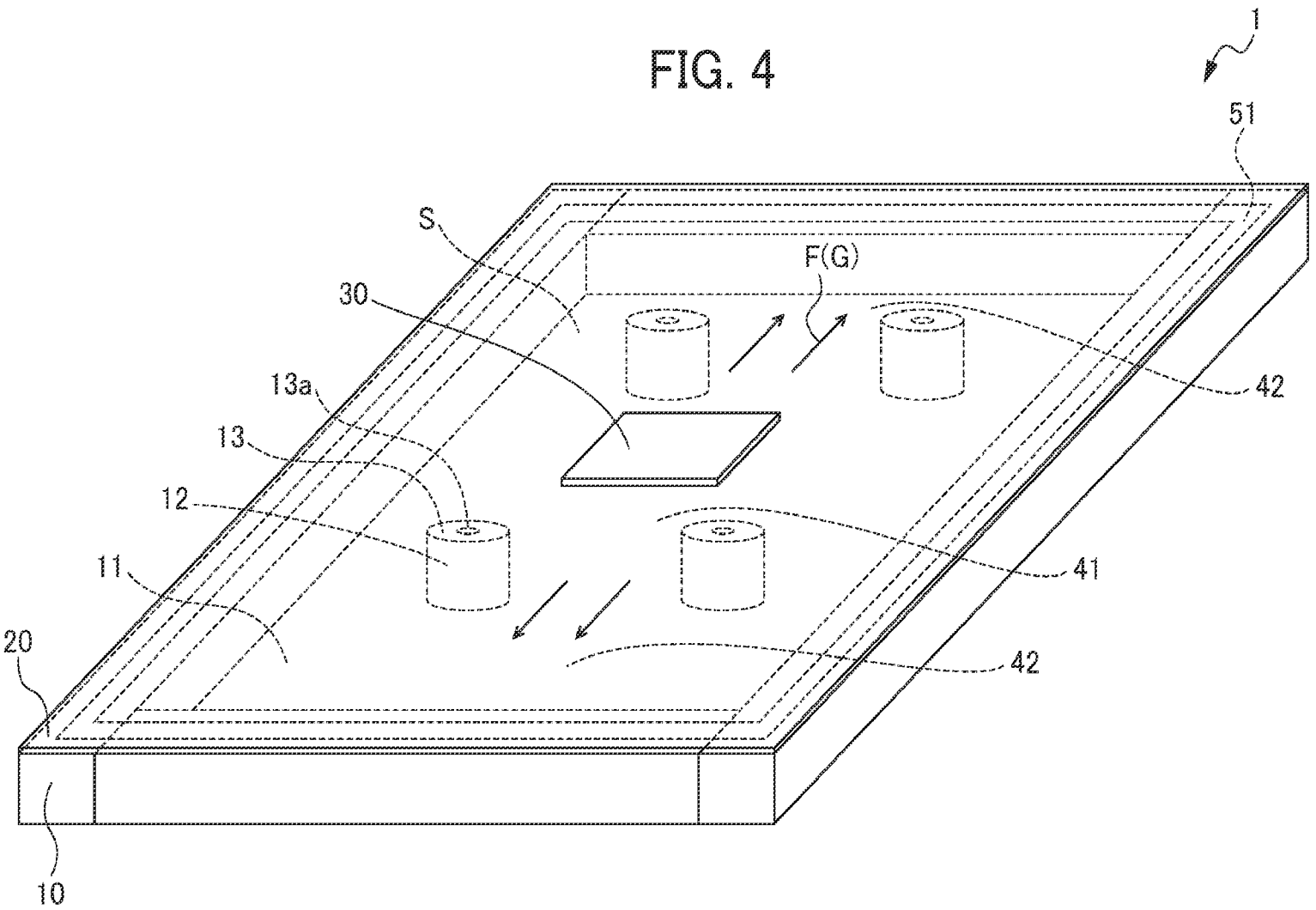
FIG. 4 is a perspective view showing another example of a projecting part constituting the vapor chamber according to the first embodiment.

In addition, although the above description illustrates an example in which the projecting part 12 is a square column as shown in FIG. 1, the shape of the projecting part 12 is sufficient so long as the top face 13 can abut the inner surface 20*a* of the second metal sheet 20. For example, the shape of the projecting part 12 may be a circular column as shown in FIG. 4. In addition, in the case of the first metal sheet 10 including a plurality of the projecting parts 12, the shapes of the projecting parts 12 may all be the same, or at least a part may differ.

Second Embodiment

Figure 5:
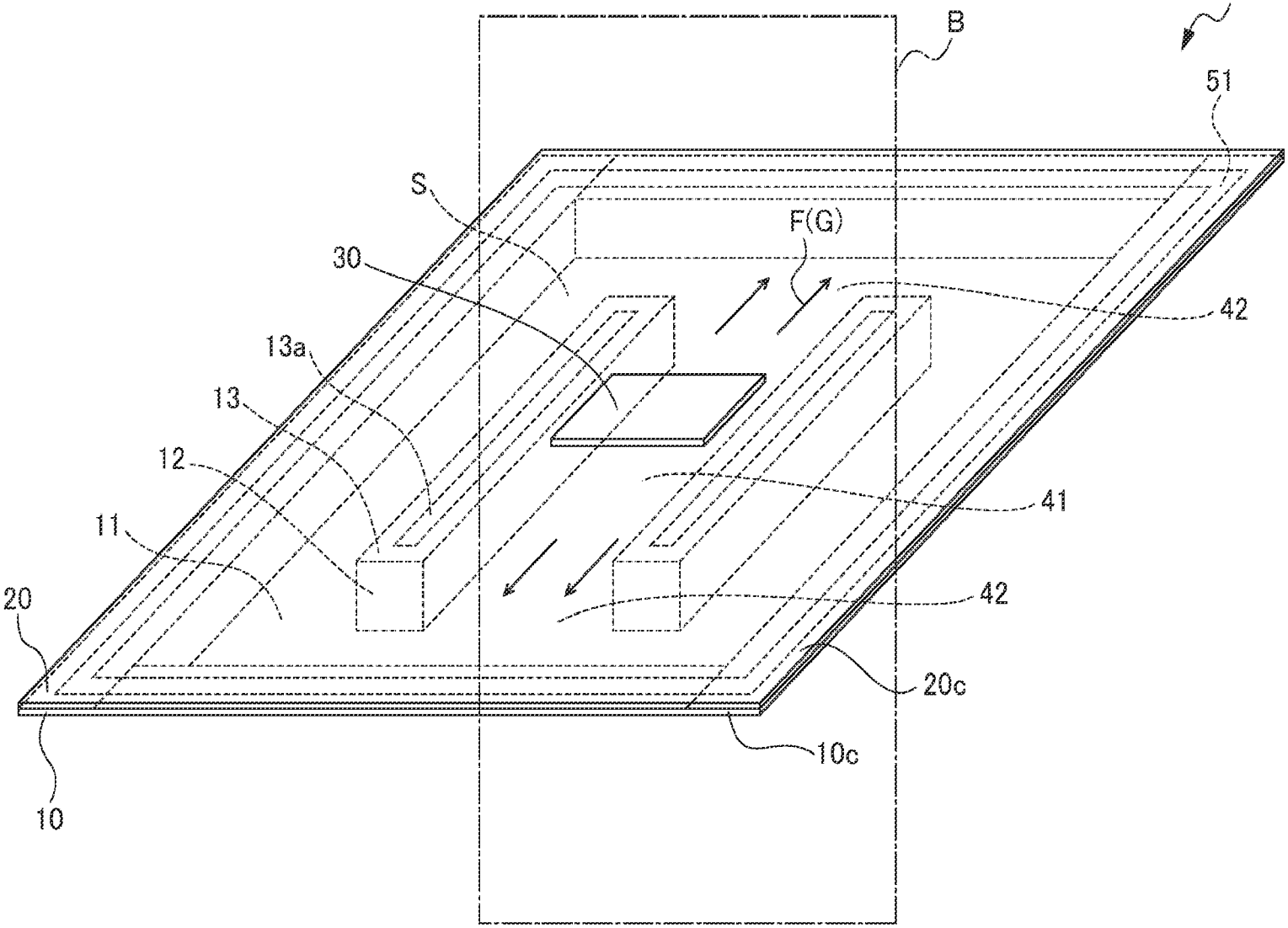
FIG. 5 is a perspective view showing an example of a vapor chamber according to a second embodiment.
Figure 6:
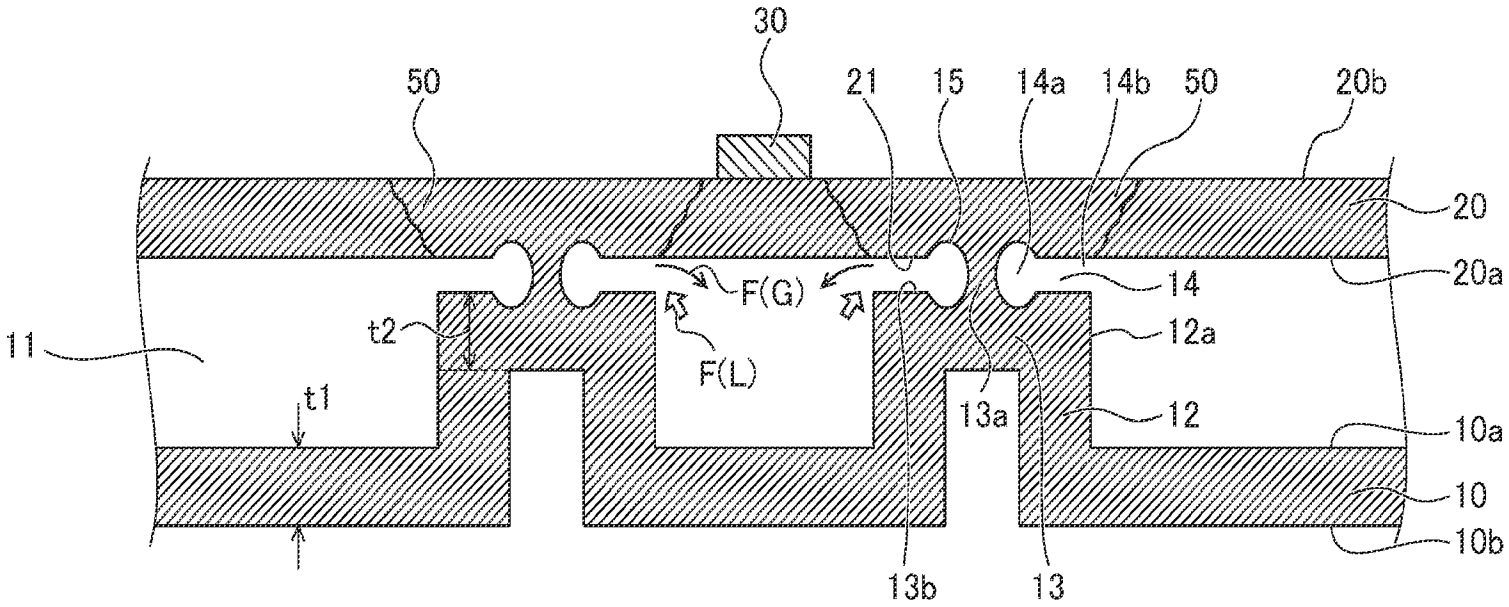
FIG. 6 is an enlarged cross-sectional view of a plane B in FIG. 5.

FIG. 5 is a perspective view showing an example of a vapor chamber according to a second embodiment. FIG. 6 is an enlarged cross-sectional view of a plane B in FIG. 5.

It should be noted that, in the embodiment shown below, the same reference numbers are assigned to constituent portions identical to the configuration of the vapor chamber of the first embodiment, and redundant explanations will be omitted or abbreviated.

A vapor chamber 2 according to the second embodiment is basically the same as the configuration of the vapor chamber 1 of the first embodiment, other than the configuration of the first metal sheet 10 differing. For this reason, this differing configuration is mainly explained herein.

As shown in FIGS. 5 and 6, the first metal sheet 10 of the vapor chamber 2 has high uniformity in the sheet thickness, compared to the first metal sheet 10 of the vapor chamber 1 of the first embodiment. In the first metal sheet 10 of the vapor chamber 1, the sheet thickness at the projecting part 12 is clearly larger than the sheet thickness at the recessed channel 11, as shown in FIG. 2.

As shown in FIG. 6, in the vapor chamber 2, the ratio (t2/t1) of the sheet thickness t2 at the projecting part 12 of the first metal sheet 10 relative to the sheet thickness t1 at the recessed channel 11 of the first metal sheet 10 is preferably 0.1 or more and 10.0 or less, more preferably 0.2 or more and 5.0 or less, even more preferably 0.5 or more and 2.0 or less, and most preferably 1.0, i.e. the sheet thickness t1 at the recessed channel 11 and the sheet thickness t2 at the projecting part 12 are equal.

When the ratio (t2/t1) is within the above-mentioned range, since the variation in sheet thickness of the first metal sheet 10 is suppressed, it is possible to lighten the weight of the vapor chamber 2. For the formation of the first metal sheet 10 having such a predetermined ratio (t2/t1), processing by press molding is favorable.

Figure 7:
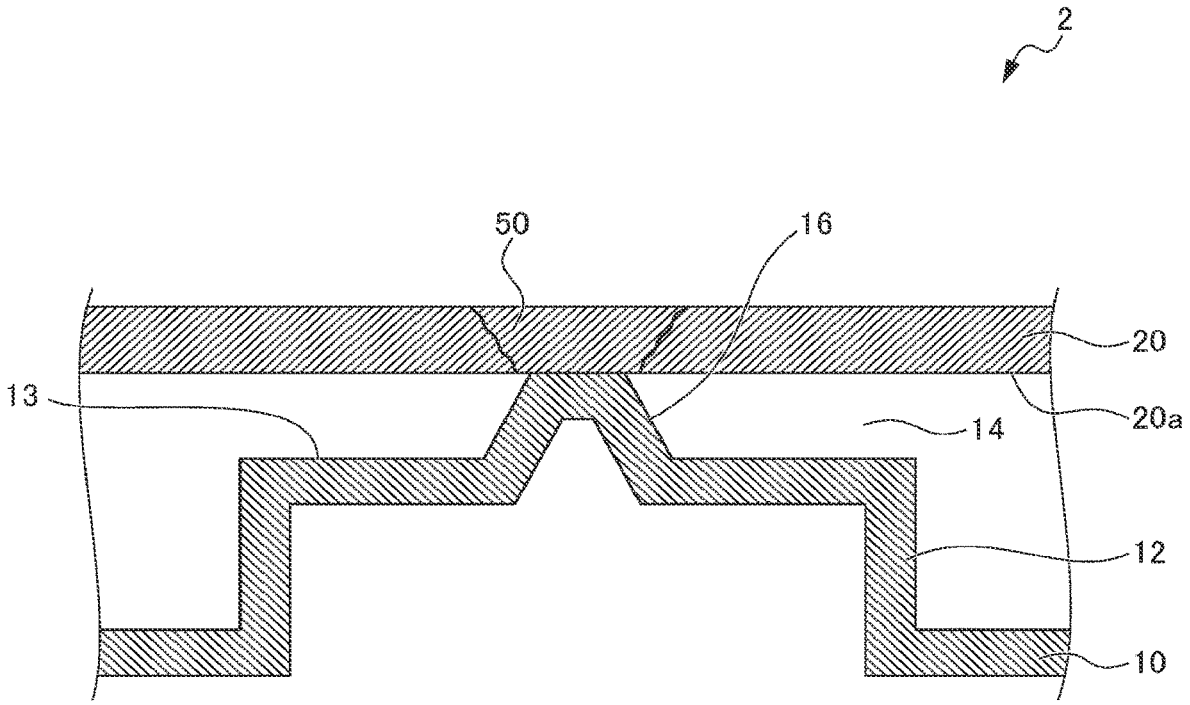
FIG. 7 is an enlarged cross-sectional view showing another example of a projecting part constituting the vapor chamber according to the second embodiment.

FIG. 7 is an enlarged cross-sectional view showing another example of the projecting part 12 constituting the vapor chamber 2. As shown in FIG. 7, the first metal sheet 10 may further have a convex part 16 which projects from part of the top face 13 toward the inner surface 20*a* of the second metal sheet 20. The top face of the convex part 16 provided to part of the top face 13 of the projecting part 12 joins to the inner surface 20*a* of the second metal sheet 20. In this case, part of the top face of the convex part 16 may join to the inner surface 20*a* of the second metal sheet 20, and the entire surface of the top face of the convex part 16 may join to the inner surface 20*a* of the second metal sheet 20. A process by press molding is suitable for the formation of the convex part 16.

When the vapor chamber 2 includes the convex part 16, since it is possible to easily control the shape of the gap flow channel part 14, it is possible to easily take the liquid-phase working fluid into the gap flow channel part 14. For this reason, the heat transport characteristic of the vapor chamber can be improved. In addition, compared to the abutting surface area between the top face joining part 13*a* and the inner surface 20*a* of the second metal sheet 20 in the vapor chamber not including the convex part 16, it is possible to easily make the abutting surface area between the top face of the convex part 16 and the inner surface 20*a* of the second metal sheet 20 smaller, and to make the annealed part 50 more locally. For this reason, it is possible to further suppress a decline in mechanical strength of the vapor chamber due to the annealed part.

Next, a manufacturing method of the above-mentioned vapor chamber 2 will be explained.

The manufacturing method of the vapor chamber 2 preferably further has a press processing step of forming the recessed channel 11 and the projecting part 12 of the first metal sheet 10 by press molding, prior to the above-mentioned laser bonding step and the laser welding step. By press molding the first metal sheet 10, it is possible to easily form the recessed channel 11 and the projecting part 12. In the press processing step, it is more preferable to also form the convex part 16 for the first metal sheet 10, in addition to the recessed channel 11 and the projecting part 12.

After the press processing step, by performing the laser welding step following the laser bonding step, or by performing the laser bonding step following the laser welding step, it is possible to manufacture the vapor chamber 2.

According to the above explained embodiment, by making the variation in sheet thickness of the first metal sheet smaller, the vapor chamber can be reduced in weight. The recessed channel and the projecting part of such a first metal sheet can be easily formed in a short time by press molding. For this reason, the vapor chamber can be manufactured more simply.

Although an embodiment has been explained above, the present invention encompasses all aspects included in the gist of the present disclosure and the claims without being limited to the above-mentioned embodiment, and can be modified in various ways within the scope of the present disclosure.

EXPLANATION OF REFERENCE NUMERALS

1, 2 vapor chamber
10 first metal sheet
10*a* inner surface of first metal sheet
10*b* outer surface of first metal sheet
10*c* outer edge of first metal sheet
11 recessed channel
12 projecting part
12*a* lateral face of projecting part
13 top face of projecting part
13*a* top face joining part
13*b* top face abutting part
14 gap flow channel part
14*a* sealed part of gap flow channel part
14*b* opening part of gap flow channel part
15 gap enlarged part
16 convex part
20 second metal sheet
20*a* inner surface of second metal sheet
20*b* outer surface of second metal sheet
20*c* outer edge of second metal sheet
21 inner surface abutting part
22 projecting part
23 top face of projecting part
30 heat generating body
41 evaporation part
42 condensation part
50 annealed part
51 welded part
S internal space
F(L) flow of liquid-phase working fluid
F(G) flow of gas-phase working fluid

The invention claimed is:

1. A vapor chamber having a working fluid in an internal space formed between a first metal sheet and a second metal sheet, wherein the first metal sheet comprises a recessed channel and at least one projecting part, wherein the recessed channel is provided at an inner surface of the first metal sheet, wherein the projecting part projects from the inner surface of the first metal sheet toward the second metal sheet, and a top face of the projecting part abuts the second metal sheet, wherein the vapor chamber includes at least one top face joining part and gap flow channel part, wherein the top face joining part joins part of the top face of the projecting part and the second metal sheet, wherein the top face of the projecting part and the second metal sheet are separated at the gap flow channel part, wherein the gap flow channel part is provided between a top face abutting part not joined to the second metal sheet in the top face of the first metal sheet, and an inner surface abutting part of the second metal sheet, such that the top face abutting part and the inner surface abutting part being spaced apart by the gap flow channels, wherein the gap flow channel part includes a gap enlarged part at a sealed part side, and wherein an average value of a gap width between the top face abutting part and the inner surface abutting part at the gap enlarged part is larger than an average value of the gap width at the gap flow channel part other than the gap enlarged part.

2. The vapor chamber according to claim 1, wherein the gap flow channel part has a sealed part at a top face joining part side of the top face abutting part, and wherein the gap flow channel part has an opening part at a projecting part lateral face side of the top face abutting part.

3. The vapor chamber according to claim 2, wherein the gap flow channel part has a longer gap length from the sealed part to the opening part than a gap width between the top face abutting part and the inner surface abutting part.

4. The vapor chamber according to claim 2, wherein the gap flow channel part has an average value of a gap width between the top face abutting part and the inner surface abutting part of 1.0 μm or more and 100.0 μm or less.

5. The vapor chamber according to claim 2, wherein the gap flow channel part has an average value of a gap length from the sealed part to the opening part of 40.0 μm or more.

6. The vapor chamber according to claim 1, wherein a ratio (t2/t1) of a sheet thickness t2 at the projecting part of the first metal sheet relative to a sheet thickness t1 at the recessed channel of the first metal sheet is 0.1 or more and 10.0 or less.

7. The vapor chamber according to claim 1, wherein the projecting part extends along a longitudinal direction of the vapor chamber.

8. The vapor chamber according to claim 1, wherein the vapor chamber includes a plurality of the top face joining parts at one of the at least one projecting part.

9. The vapor chamber according to claim 1, wherein the second metal sheet includes at least one projecting part at an inner surface, and wherein the projecting part of the second metal sheet projects from the inner surface of the second metal sheet toward the first metal sheet, and a top face of the projecting part abuts the recessed channel of the first metal sheet.

10. A manufacturing method of the vapor chamber according to claim 1, the manufacturing method comprising:

a laser bonding step of forming the top face joining part by laser.

11. The manufacturing method of the vapor chamber according to claim 10, further comprising a laser welding step of welding an outer edge of the first metal sheet and an outer edge of the second metal sheet by laser, before or after the laser bonding step.

12. The manufacturing method of the vapor chamber according to claim 10, further comprising a press processing step of forming the recessed channel and the projecting part of the first metal sheet by press molding, prior to the laser bonding step and the laser welding step.

13. The vapor chamber according to claim 3, wherein the gap flow channel part has an average value of a gap width between the top face abutting part and the inner surface abutting part of 1.0 μm or more and 100.0 μm or less.

14. The vapor chamber according to claim 3, wherein the gap flow channel part has an average value of a gap length from the sealed part to the opening part of 40.0 μm or more.

15. The vapor chamber according to claim 2, wherein a ratio (t2/t1) of a sheet thickness t2 at the projecting part of the first metal sheet relative to a sheet thickness t1 at the recessed channel of the first metal sheet is 0.1 or more and 10.0 or less.

16. The vapor chamber according to claim 2, wherein the projecting part extends along a longitudinal direction of the vapor chamber.

17. The vapor chamber according to claim 2, wherein the vapor chamber includes a plurality of the top face joining parts at one of the at least one projecting part.

18. The vapor chamber according to claim 2, wherein the second metal sheet includes at least one projecting part at an inner surface, and wherein the projecting part of the second metal sheet projects from the inner surface of the second metal sheet toward the first metal sheet, and a top face of the projecting part abuts the recessed channel of the first metal sheet.

* * * * *